US006773193B2

(12) United States Patent
Delage

(10) Patent No.: US 6,773,193 B2
(45) Date of Patent: Aug. 10, 2004

(54) PACKAGING AND APPLICATOR DEVICE INCLUDING AN ELEMENT FORMING AN INTERMEDIATE RESERVOIR

(75) Inventor: Jean-François Delage, Paris (FR)

(73) Assignee: L'Oreal S.A., Paris (FR)

( * ) Notice: Subject to any disclaimer, the term of this patent is extended or adjusted under 35 U.S.C. 154(b) by 41 days.

(21) Appl. No.: 09/779,871

(22) Filed: Feb. 8, 2001

(65) Prior Publication Data

US 2001/0031171 A1 Oct. 18, 2001

(30) Foreign Application Priority Data

Feb. 16, 2000 (FR) ..... 00 01901

(51) Int. Cl.[7] ..... B43K 5/00
(52) U.S. Cl. ..... 401/205; 401/196
(58) Field of Search ..... 401/140, 196, 401/202, 205, 206, 207, 198, 199

(56) References Cited

U.S. PATENT DOCUMENTS

| | | | | |
|---|---|---|---|---|
| 4,588,319 A | * | 5/1986 | Niemeyer | 401/205 |
| 4,902,155 A | * | 2/1990 | Buschemeyer | 401/206 |
| 5,035,524 A | | 7/1991 | Sakurai | 401/206 |
| 5,197,815 A | * | 3/1993 | Sibley | 401/202 |
| 5,199,808 A | | 4/1993 | Gueret | 401/133 |
| 5,230,579 A | | 7/1993 | Klawson et al. | |
| 5,454,658 A | | 10/1995 | Kato | 401/205 |
| 5,454,659 A | * | 10/1995 | Vosbikian et al. | 401/207 |
| 5,876,139 A | | 3/1999 | De Laforcade | 401/190 |
| 5,890,828 A | | 4/1999 | Gueret | |
| 6,398,442 B1 | * | 6/2002 | Furukawa | 401/198 |

FOREIGN PATENT DOCUMENTS

| | | |
|---|---|---|
| DE | 3525150 A1 | 1/1987 |
| EP | 362 977 A2 | 4/1990 |
| EP | 678 458 A1 | 10/1995 |
| JP | U4-30148 | 7/1992 |

* cited by examiner

*Primary Examiner*—Gregory L. Huson
*Assistant Examiner*—Peter deVore
(74) *Attorney, Agent, or Firm*—Finnegan, Henderson, Farabow, Garrett & Dunner, LLP

(57) ABSTRACT

A device for packaging and applying a substance, in particular a cosmetic or a care product, the device comprising a receptacle for containing the substance, said receptacle being provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position, said intermediate reservoir-forming element also being arranged to enable the substance retained in this way to feed the applicator, at least in certain conditions of use of the device.

25 Claims, 5 Drawing Sheets

PACKAGING AND APPLICATOR DEVICE INCLUDING AN ELEMENT FORMING AN INTERMEDIATE RESERVOIR

The present invention relates to a device for packaging and applying a substance, in particular a cosmetic or a care product, the device comprising a receptacle for containing the substance, said receptacle being provided at the top with an applicator that is permeable to the substance and that has an inside face fed with the substance coming from the receptacle.

BACKGROUND OF THE INVENTION

Numerous devices of that type are known.

In use, the substance contained in the receptacle reaches the inside face of the applicator and travels towards its outside face through the material constituting the applicator, so as to come into contact with the skin of the user.

When the receptacle has a flexible wall, the user can feed the applicator by squeezing the receptacle wall.

However, when the receptacle has a rigid wall, the user is faced with the problem of how long the device can continue to be used in the head-up position, or even when the device is used horizontally and only a small quantity of substance remains in the receptacle.

In addition, the substance can have difficulty in diffusing through the applicator given its consistency.

OBJECTS AND SUMMARY OF THE INVENTION

There thus exists a need for a device that can be used for longer at a stretch and more comfortably.

In the novel packaging and applicator device of the invention, in the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position, said intermediate reservoir-forming element also being arranged to enable the substance retained in this way to feed the applicator, at least in certain conditions of use of the device.

By means of the invention the device can continue to be used for longer in the head-up position without any need to reload the applicator by turning the receptacle upside-down.

In addition, the intermediate reservoir-forming element can feed the applicator while the device is being used horizontally or substantially horizontally and the quantity of substance in the receptacle is insufficient to reach the applicator directly.

Advantageously, the intermediate reservoir-forming element and the applicator are arranged in such a manner that, in use, the applicator comes into contact with the substance retained by the intermediate reservoir-forming element when sufficient pressure is exerted on the applicator.

Passage of the substance through the applicator can also be enhanced by giving the intermediate reservoir-forming element a shape that is selected in such a manner that the substance contained in the intermediate reservoir-forming element is compressed by the applicator when the applicator is pressed against the intermediate reservoir-forming element, thus causing the substance to pass through the applicator.

Advantageously, the applicator is made of an open-celled, elastically deformable, cellular material, e.g. a foam or a sponge.

In a particular embodiment, the intermediate reservoir-forming element includes a cup which is concave towards the applicator, so as to retain a certain quantity of substance when the device is turned upside-down and then returned to the head-up position.

Still in a particular embodiment, the intermediate reservoir-forming element includes partitions tending to oppose return of the substance retained by the intermediate reservoir-forming element to the bottom of the receptacle when the device is tilted relative to the vertical from an initial head-up position.

Advantageously, said partitions are cylindrical, about the same axis as the receptacle.

In a variant, the partitions are provided with gaps that allow the substance to flow between them.

The distribution of the substance in the intermediate reservoir-forming element can thus be made to be more uniform.

In a particular embodiment, the applicator has an outside face of dome shape, and the inside face defines a recess into which the intermediate reservoir-forming element is engaged, at least in part.

Thus, in use, a small amount of deformation in the applicator suffices to cause the substance retained in the intermediate reservoir-forming element to come into contact with the applicator.

In a particular embodiment, the applicator is secured at its periphery to a support piece made of non-cellular material, e.g. a semi-rigid plastics material.

This support piece contributes to facilitating assembly of the applicator and its replacement, where appropriate.

In a particular embodiment, the receptacle has a bottom body and a top portion for receiving a closure cap, said top portion being constituted by a piece fitted on the body.

The bottom body is preferably made of a rigid plastics material for reasons of appearance.

In a particular embodiment, the top portion of the receptacle has a neck onto which the closure cap can be screwed.

Still in a particular embodiment, the top portion of the receptacle includes fastening means suitable for co-operating with the support piece of the applicator by snap-fastening.

Advantageously, the support piece of the applicator has two fastening tabs that are diametrically opposite and arranged when pressed inwards to enable the applicator to be separated from the receptacle, so as to enable it to be cleaned or replaced, for example.

Advantageously, the intermediate reservoir-forming element and the remainder of the top portion of the receptacle are made as a single piece by molding a plastics material.

In a particular embodiment, the intermediate reservoir-forming element is supported by a perforated wall having lateral passages allowing the substance contained in the receptacle to reach the space lying between the intermediate reservoir-forming element and the bottom face of the applicator when the receptacle is turned upside-down.

Advantageously, the above-mentioned perforated wall is connected to the intermediate reservoir-forming element without forming a projecting edge.

This reduces the risk of the applicator being damaged in use when pressed against the intermediate reservoir-forming element.

The region of the bottom face of the applicator that is directly in register with the intermediate reservoir-forming element may be plane or convex towards said element, so as to facilitate contact between the applicator and the substance retained in the intermediate reservoir-forming element.

In a variant embodiment, the applicator occupies substantially the entire inside volume of the intermediate reservoir-forming element, said inside volume being that in which the substance retained by the intermediate reservoir-forming element can accumulate.

In a particular embodiment, the reservoir-forming element has a rigid wall.

The invention also provides the use of a packaging and applicator device as defined above to apply a substance constituted by a cosmetic or care product to the body.

BRIEF DESCRIPTION OF THE DRAWINGS

The invention will be better understood on reading the following detailed description of non-limiting embodiments, and on examining the accompanying drawings, in which.

MORE DETAILED DESCRIPTION

Figure 1:
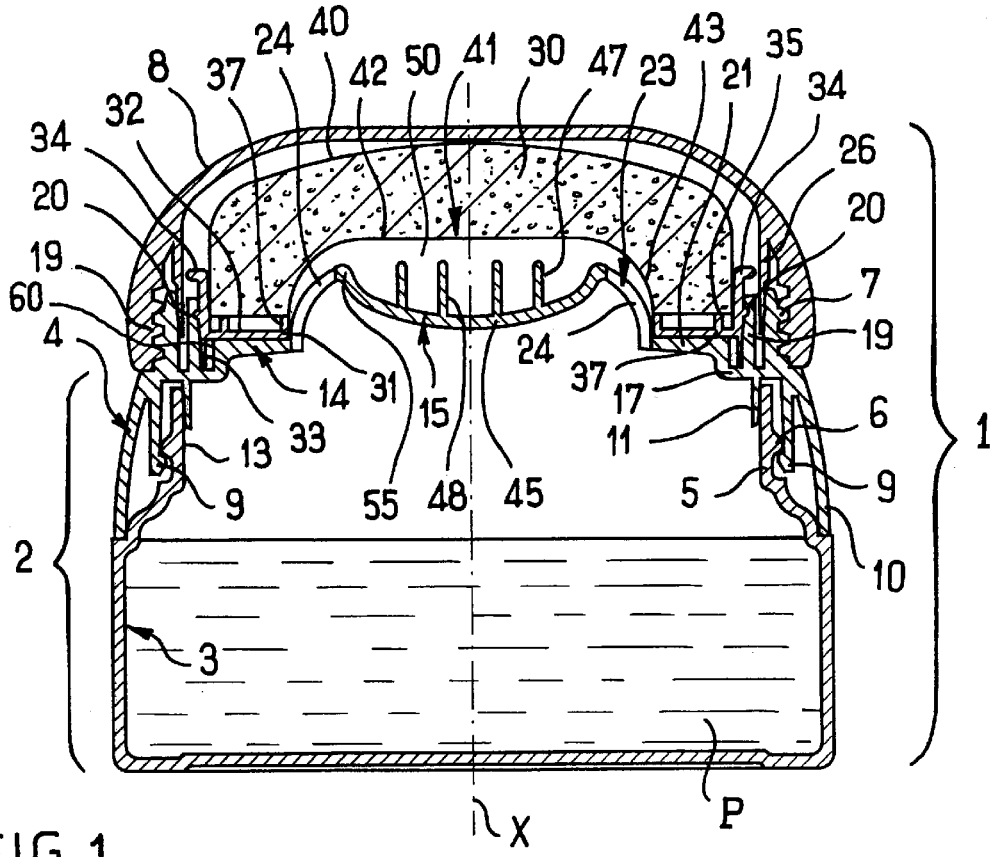
FIG. 1 is a diagrammatic axial section view of a packaging and applicator device of the invention.

The packaging and applicator device 1 shown in the figures comprises a receptacle 2 made by assembling together a bottom body 3 and a top portion 4 both of which are made of a rigid plastics material.

The bottom body 3 has a side wall that is circularly cylindrical about the axis X and that is extended upwards by a neck 5 about the axis X and provided on the outside with an annular bead 6.

The top portion 4 has an externally threaded neck 7 for receiving a closure cap 8.

The neck 7 is extended downwards by fixing tabs 9 shaped to snap under the annular bead 6.

The top portion 4 also has an outer skirt 10 surrounding the fixing tabs 9 and taking up a position in line with the side wall of the body 3, and an annular sealing lip 11 that presses in leakproof manner against the radially inner surface 13 of the neck 5.

The top portion 4 of the receptacle also has a stepped wall 14 which extends radially inwards, generally perpendicularly to the axis X, and which serves as a support for an element 15 that forms an intermediate reservoir whose function is described in greater detail.

The stepped wall 14 has a first annular portion 17 which is connected to the base of the threaded neck 7 and which serves as a support for an assembly skirt 19 that is circularly symmetrical about the axis X and that extends upwards, said assembly skirt 19 being provided on its radially inner skirt with an annular groove 20 in the vicinity of its top end.

The first annular portion 17 is extended inwards by a second annular portion 21 extending parallel to the axis X where it connects to the first annular portion 17 so as to form an annular groove 60, after which it extends perpendicularly to the axis X.

The intermediate reservoir-forming element 15 is connected to the second annular portion 21 via a curved wall 23 provided with openings 24, there being four such openings in the example described, these openings 24 being uniformly distributed around the axis X.

The receptacle 2 is filled with a substance such as a cosmetic or a care product P.

The closure cap 8 has an annular sealing lip 26 which is pressed in sealed manner against the radial inner surface of the neck 7, as can be see in FIG. 1.

The packaging and applicator device 1 has an applicator 30 made of a cellular material of an open-celled plastics material, for example a foam or a sponge.

The applicator 30 is secured via its periphery to an annular support piece 31 made of a rigid or a semi-rigid plastics material.

This support piece 31 has a base wall 32 which bears against the second annular portion 21 of the stepped wall 14.

The base wall 32 is connected at its outer periphery firstly to an annular sealing lip 33 which extends downwards and bears in leakproof manner against the radially inner surface of the assembly skirt 19 beneath the annular groove 20, and secondly to two diametrically opposite fixing tabs 34 extending upwards and extending the annular sealing lip 33.

Each of the fixing tabs 34 has a projection 35 that snaps into the annular groove 20 of the assembly skirt 19.

In the embodiment described, it will be observed that the applicator 30 does not rest directly on the base wall 32, but is fixed via its bottom end edge to annular ribs 37 that project upwards from the base wall 32, being fixed to the ribs 37 by any conventional means, for example by heat-sealing or by adhesive.

At rest, the applicator 30 has an outside face 40 that is dome-shaped and an inside face 41 including a central region 42 that faces the intermediate reservoir-forming element 15 directly on the axis X, which face is plane and perpendicular to the axis X, together with a peripheral region 43 that is rounded, being concave towards the receptacle and of larger radius of curvature than the curved wall 23.

The intermediate reservoir-forming element 15 has a cup 45 that is concave towards the applicator 30, this cup 45 is connected to the curved wall 23 via its peripheral edge 55 without forming a projecting edge and supporting, in the embodiment described, two partitions 47 and 48 that are circularly cylindrical about the axis X.

The height of the partitions 47 and 48 is selected so that their top ends lie substantially in the same plane as the peripheral edge 55 of the cup 45, said plane extending perpendicularly to the axis X.

In the embodiment described, all of the elements constituting the top portion of the receptacle 4 are made as a single piece by molding a plastics material.

The device 1 is used as follows.

Figure 2:
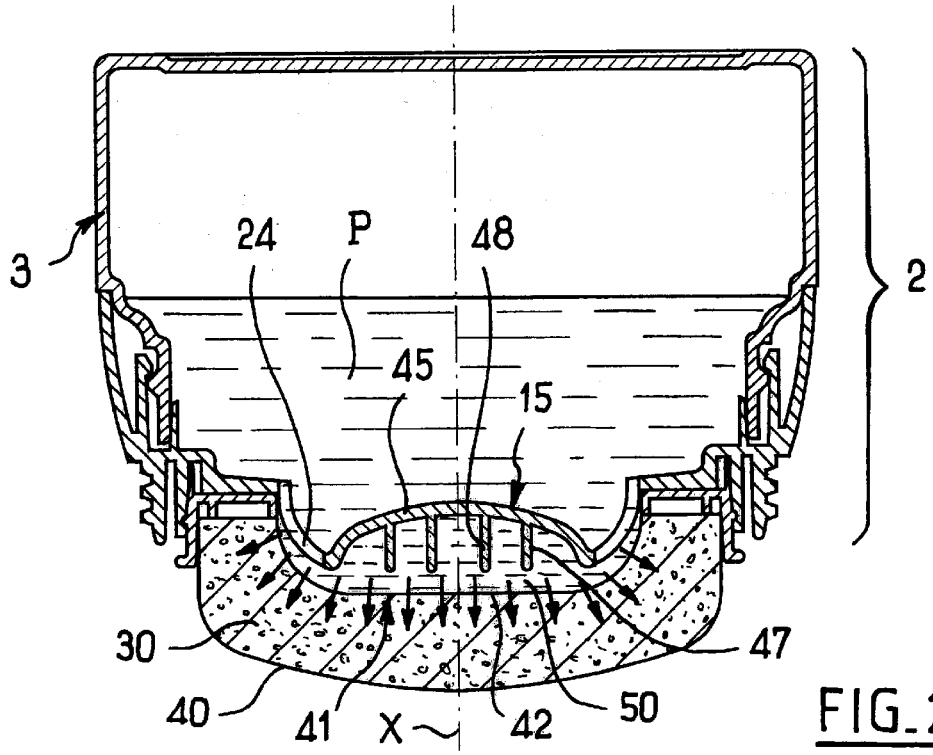
FIG. 2 shows the FIG. 1 device after its closure cap has been removed and the receptacle has been turned upside-down to moisten the applicator.

Once the closure cap 6 has been removed, the user turns the receptacle 2 into a head-down position, as shown in FIG. 2, so as to moisten the applicator 30 with the substance P.

By passing through the openings 24, the substance P penetrates into the space 50 that extends between the intermediate reservoir-forming element 15 and the inside face 41 of the applicator, and it diffuses therefrom towards the outside face 40 by capillarity and/or by gravity through the porous material that constitutes the applicator 30.

Figure 3:
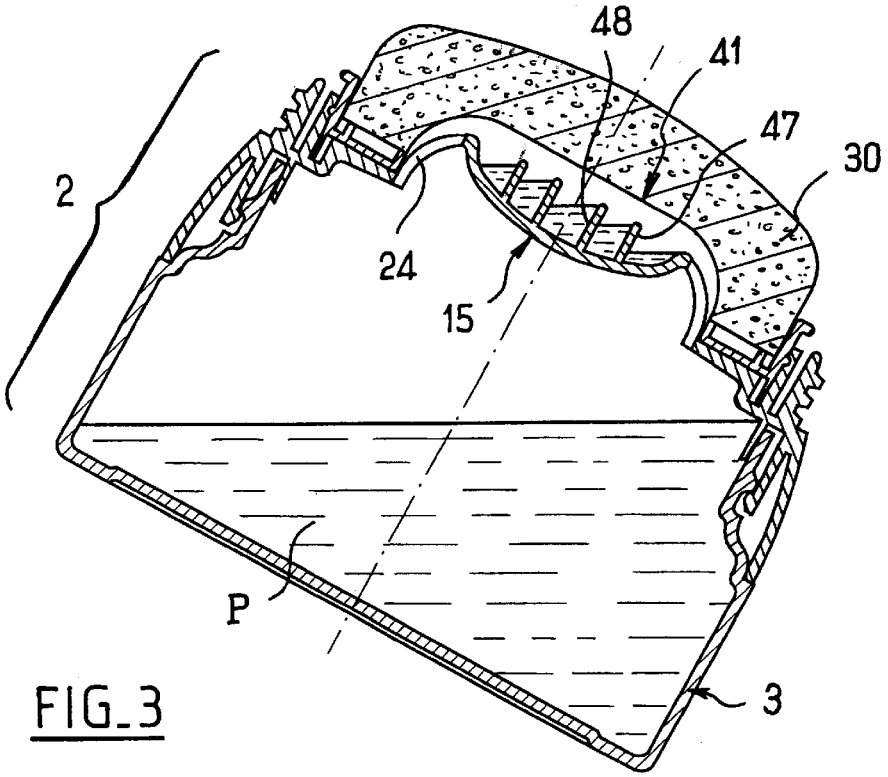
FIG. 3 shows how substance is retained by the intermediate reservoir-forming element when the receptacle is tilted.

When the receptacle 2 is returned to a head-up position as shown in FIG. 3, the substance P returns to the bottom of the body 3 of the receptacle, except for a quantity thereof which is retained by the intermediate reservoir-forming element 15.

The partitions 47 and 48 participate in retaining the substance in the intermediate reservoir-forming element 15.

The volume of substance that is retained in the intermediate reservoir-forming element can lie in the range 0.5 cubic centimeters ($cm^3$) to 3 $cm^3$.

Figure 4:
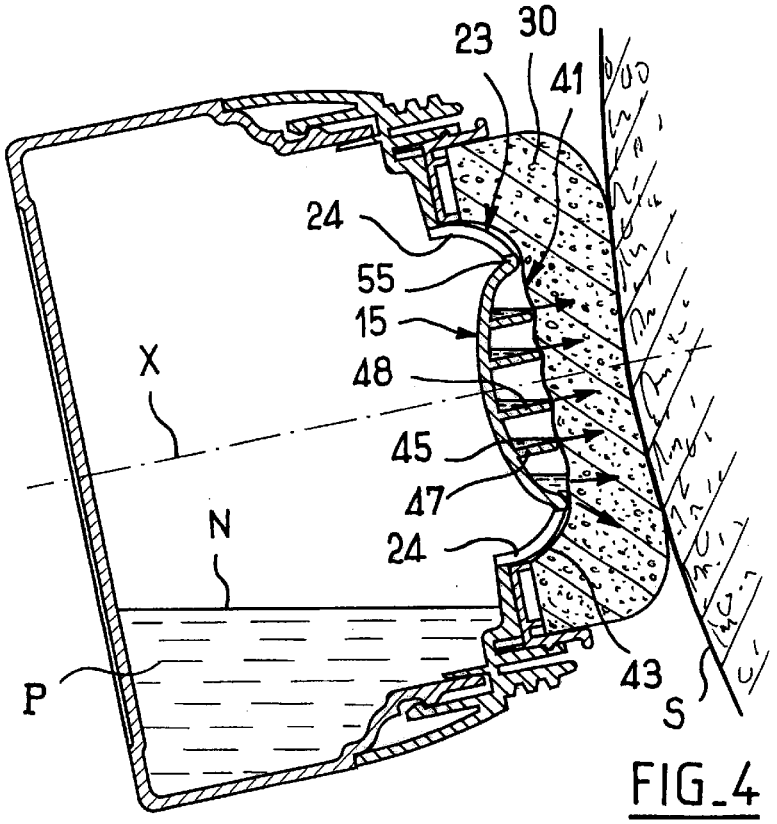
FIGS. 4 and 5 show the device under certain conditions of use.

The applicator 30 moistened with the substance P can then be placed against the skin S as shown in FIG. 4, with the axis X then taking up a variety of orientations, and in particular an orientation that can be horizontal or substantially horizontal.

The substance P contained in the applicator 30 is deposited on the skin S by moving the device 1.

The pressure that is exerted by the applicator 30 on the skin S in use has the effect of deforming the applicator and bringing its inside surface 41 into contact with the intermediate reservoir-forming element 15, as shown in FIG. 4.

As a result, the substance P that is retained by the intermediate reservoir-forming element 15 can diffuse by capillarity and/or gravity into the applicator 30, thereby enabling it to be used for longer.

It should also be observed that because the intermediate reservoir-forming element 15 is engaged practically completely in the setback defined by the inside face 41 of the applicator 30, applying a small amount of pressure to the applicator 30 suffices to bring its inside face 41 into contact with the peripheral edge 55 of the cup 45, thereby preventing the substance retained in the cup 45 from escaping through the openings 24 and returning to the bottom of the receptacle 2.

The substance is thus constrained to diffuse into the applicator 30.

Bringing the inside face 41 to bear against the partitions 47 and 48 acts in a similar manner to force the substance P to flow into the applicator 30 rather than returning into the bottom of the receptacle.

On examining FIG. 4, it will be observed that the radius of curvature of the peripheral region 43 of the inside face 41 of the applicator 30 is selected in such a manner that when the applicator 30 comes to bear against the partitions 47 and 48 and the peripheral edge 55 of the cup 45, the peripheral region 43 extends substantially parallel to the curved wall 23.

It should also be observed on examining FIG. 4 that the intermediate reservoir-forming element 15 enables the applicator 30 to be fed by means of substance that is retained inside the cup 45 when the level N of substance is too low to enable it to feed the applicator 30 directly through the openings 24.

Figure 5:
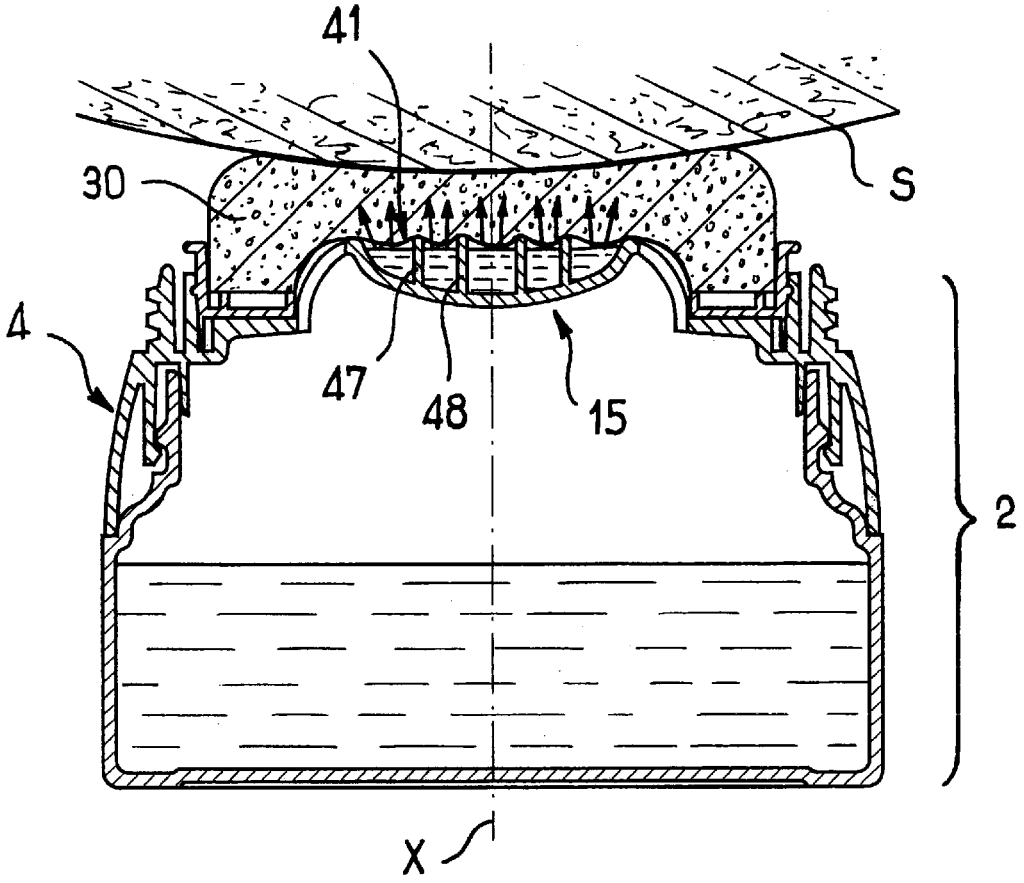

FIG. 5 shows the receptacle 2 being used head-up, the intermediate reservoir-forming element 15 being almost completely filled.

On examining this figure, it will be understood that the invention makes it possible to increase the length of time during which the applicator 30 can be used since under pressure exerted thereon when it is applied to the skin S, the bottom face 41 can come into contact with substance that has been retained in the intermediate reservoir-forming element 15. The applicator 30 is thus fed by capillarity.

In addition, when the quantity of substance in the intermediate reservoir-forming element 15 is sufficient, when the applicator 30 penetrates between the partitions 47 and 48 it tends to compress the substance P contained in the intermediate reservoir-forming element, thereby expelling the substance into the applicator 30.

The applicator can easily be separated from the top portion 4 of the receptacle 2 by deforming the fixing tabs 34 inwards, thereby enabling the projections 35 to be disengaged from the annular groove 20 of the assembly skirt 19.

Naturally, the invention is not limited to the embodiment described above.

Figure 6:
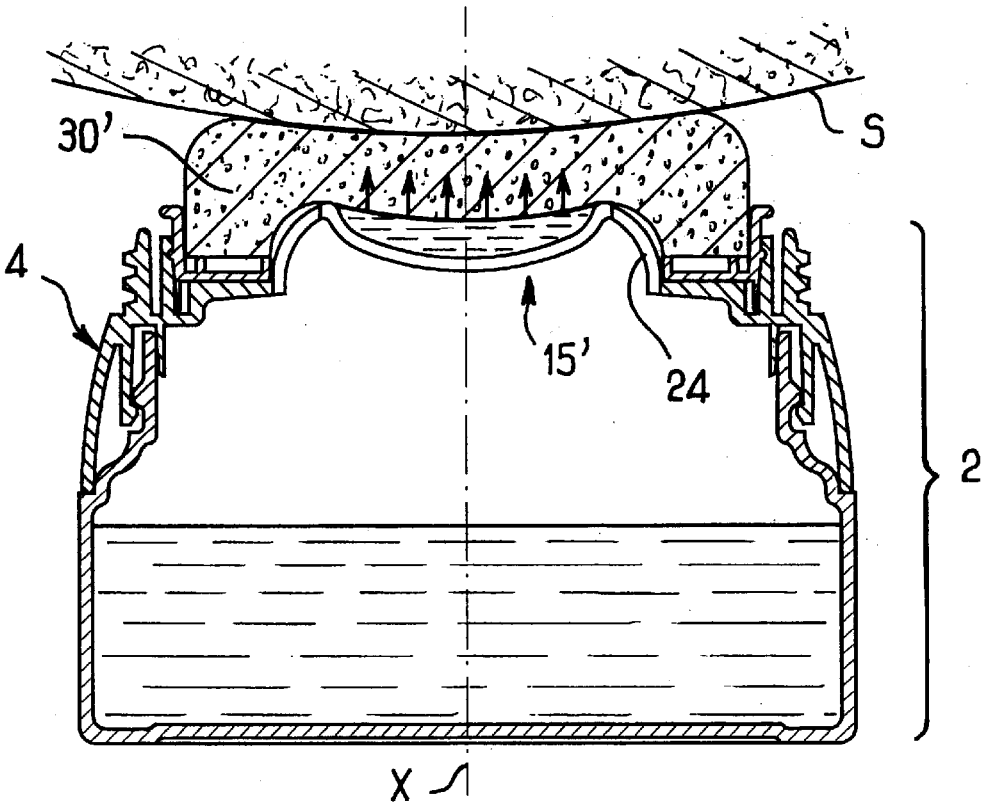
FIG. 6 is a view analogous to FIG. 5 showing a variant embodiment.

FIG. 6 shows a variant embodiment which differs from the above-described device by the fact that the intermediate reservoir-forming element 15 is replaced by an intermediate reservoir-forming element 15' that no longer has partitions 47 and 48.

The device provides a result that is identical.

The absence of partitions 47 and 48 enables the applicator to press further into the intermediate reservoir-forming element 15' in use.

Figure 7:
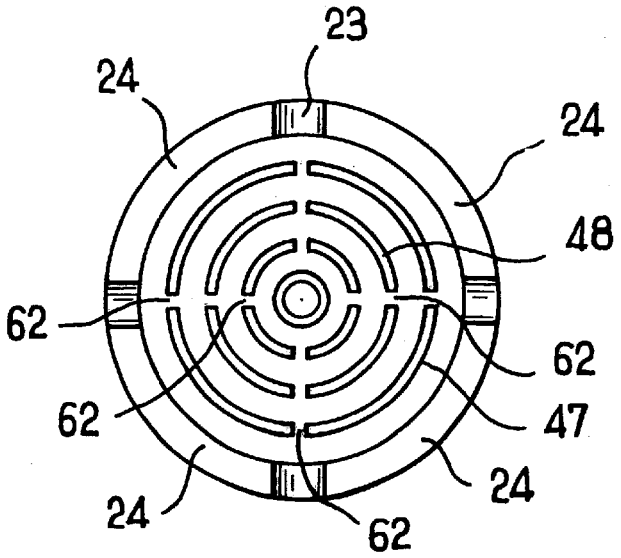
FIG. 7 is a view from above of a variant embodiment of the intermediate reservoir-forming element.

FIG. 7 shows a variant in which the partitions 47 and 48 are replaced by partitions 47' and 48' that leave gaps 62 allowing the substance to circulate between the rings formed by the partitions 47' and 48'. This ensures that the substance is distributed more uniformly in the intermediate reservoir-forming element.

The partitions 47' and 48' constitute bearing surfaces against which the applicator comes to bear when the device is in use.

Figure 8:
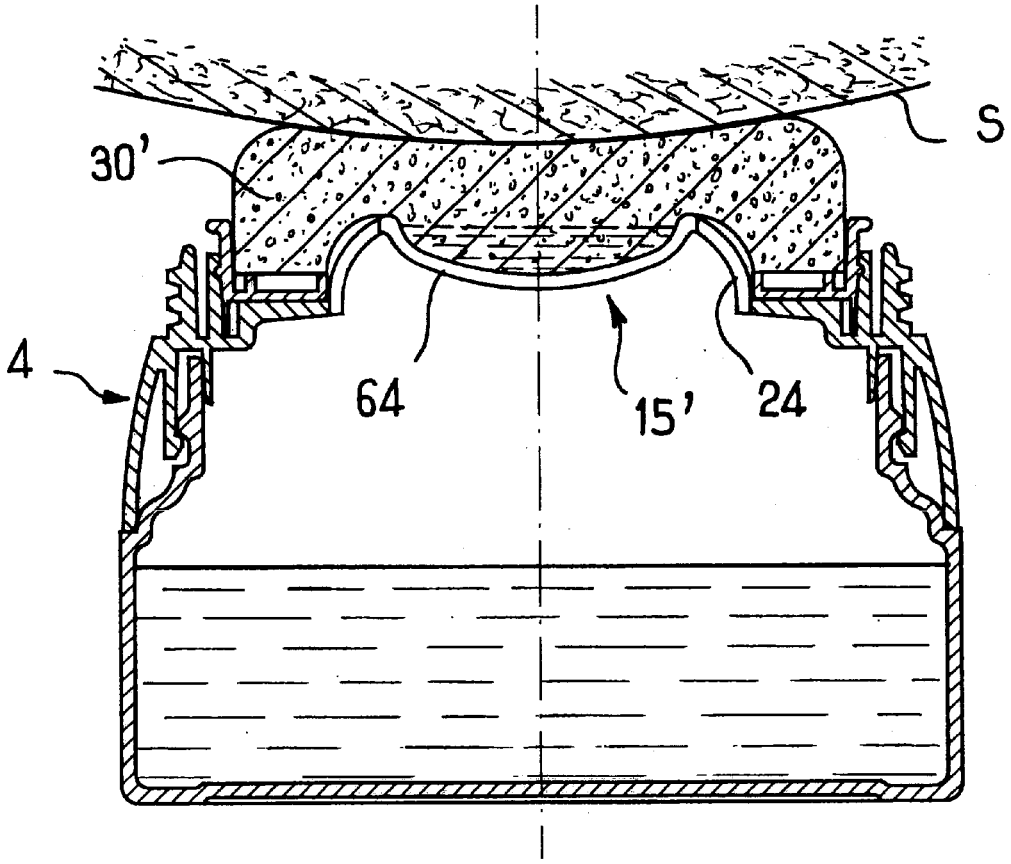
FIG. 8 is a view analogous to FIG. 5 for another variant embodiment.

The device shown in FIG. 8 differs from that shown in FIG. 6 in that the applicator 30 is replaced by an applicator 30' having a central portion 64 which matches the concave shape of the intermediate reservoir-forming element 15'.

In other words, the cellular material constituting the applicator 30' occupies the entire inside volume of the intermediate reservoir-forming element 15'.

The substance accumulates inside the intermediate reservoir-forming element 15' within the cellular material constituting the applicator 30'.

In variants that are not shown, it is also possible to make an applicator with a coating for making it more comfortable in use, e.g. flocking.

In order to make the applicator, it is possible to use any material that is arranged to allow the substance to pass through it by capillarity and/or gravity.

The intermediate reservoir-forming element can be made to have a shape or a structure that differs from those shown.

What is claimed is:

1. A device for packaging and applying a substance comprising:

a receptacle for containing the substance;

an applicator associated with the receptacle, the applicator being permeable to the substance and having an inside face fed with substance coming from the receptacle; and an intermediate reservoir located between the receptacle and the inside face of the applicator, said intermediate reservoir being in permanent flow communication with the receptacle and being configured to retain a quantity of substance when the device is inverted and returned to an upright position, said intermediate reservoir and the applicator being configured to permit substance within the intermediate reservoir to feed the applicator.

2. The device according to claim 1, wherein the intermediate reservoir and the applicator are configured such that the applicator comes into contact with substance retained by the intermediate reservoir when sufficient pressure is exerted on the applicator.

3. The device according to claim 1, wherein the applicator is formed from an open-celled, elastically deformable, cellular material.

4. The device according to claim 1, wherein the intermediate reservoir comprises a cup which is concave with respect to the applicator.

5. The device according to claim 1, wherein the intermediate reservoir comprises partitions configured to oppose return of substance within the intermediate reservoir to the receptacle when the device is tilted relative to vertical from an upright position.

6. The device according to claim 5, wherein said partitions are cylindrical and substantially coaxial with an axis of the receptacle.

7. The device according to claim 1, wherein the intermediate reservoir comprises partitions having gaps configured to permit substance to flow therebetween.

8. The device according to claim 1, wherein the applicator comprises an outside face having a dome shape, and wherein the inside face defines a recess into which at least a portion of the intermediate reservoir is engaged.

9. The device according to claim 1, further comprising a support piece formed from a non-cellular material, wherein the applicator has a periphery secured to said support piece.

10. The device according to claim 1, wherein the receptacle comprises a body and a top portion for receiving a closure cap, said top portion comprising a piece fitted on the body.

11. The device according to claim 10, wherein the top portion of the receptacle comprises a fastener for co-operating with the support piece of the applicator via snap-fastening.

12. The device according to claim 11, wherein the support piece of the applicator comprises two fastening tabs, the two fastening tabs being substantially diametrically opposed from each other and being configured to allow the applicator to be separated from the receptacle when deflected inwardly.

13. The device according to claim 10, wherein the body is formed from a rigid plastic material.

14. The device according to claim 10, wherein the top portion of the receptacle comprises a neck configured to receive the closure cap via a threading action.

15. The device according to claim 10, wherein the intermediate reservoir and the remainder of the top portion of the receptacle are made as a single piece.

16. The device according to claim 1, wherein the intermediate reservoir is supported by a perforated wall having lateral passages allowing substance contained in the receptacle to reach the intermediate reservoir and the inside face of the applicator when the receptacle is turned upside-down.

17. The device according to claim 16, wherein the perforated wall is connected to the intermediate reservoir without forming a projecting edge.

18. The device according to claim 1, wherein the inside face of the applicator comprises a region directly registered with the intermediate reservoir, the region being substantially planar.

19. The device according to claim 1, wherein the intermediate reservoir defines a volume for accumulating and retaining substance and the applicator occupies substantially the entire volume.

20. The device according to claim 1, wherein the receptacle contains a liquid.

21. The device according to claim 1, wherein the reservoir has a rigid wall.

22. The device according to claim 1, wherein the inside face of the applicator comprises a region directly registered with the intermediate reservoir, the region being substantially convex as viewed from an interior of said intermediate reservoir.

23. A method of applying a substance to the body, the method comprising:

providing the device of claim 1; and contacting the applicator to the body, wherein the substance is chosen from a cosmetic product and a care product.

24. A device for applying a substance, the device comprising:

a receptacle for containing a substance;

a substance contained in the receptacle, the substance comprising one of a cosmetic product and a care product;

a reservoir forming element connected to the receptacle; and an applicator connected to the reservoir forming element, wherein the applicator and the reservoir forming element are configured to define an intermediate reservoir, the intermediate reservoir being in permanent flow communication with the receptacle, wherein the intermediate reservoir is in flow communication with the receptacle at least before the first use of the device, and wherein the applicator and the reservoir forming element are configured to apply the substance while connected to the receptacle.

25. A device for applying a substance, the device comprising:

a receptacle for containing a substance;

a reservoir forming element connected to the receptacle; and an applicator connected to the reservoir forming element, wherein the applicator and the reservoir forming element are configured to define a space therebetween defining an intermediate reservoir and to permit substantially unobstructed flow communication between the intermediate reservoir and the applicator, wherein the intermediate reservoir is in flow communication with the receptacle at least before the first use of the device, and wherein the applicator and the reservoir forming element are configured to apply the substance while connected to the receptacle.

* * * * *